US011780649B2

(12) United States Patent
Hayashi et al.

(10) Patent No.: US 11,780,649 B2
(45) Date of Patent: Oct. 10, 2023

(54) PLUG BODY AND BEVERAGE CONTAINER

(71) Applicant: TIGER CORPORATION, Osaka (JP)

(72) Inventors: Shinji Hayashi, Osaka (JP); Saho Tanei, Osaka (JP)

(73) Assignee: TIGER CORPORATION, Osaka (JP)

( * ) Notice: Subject to any disclaimer, the term of this patent is extended or adjusted under 35 U.S.C. 154(b) by 0 days.

(21) Appl. No.: 17/576,996

(22) Filed: Jan. 16, 2022

(65) Prior Publication Data

US 2022/0306349 A1 Sep. 29, 2022

(30) Foreign Application Priority Data

Mar. 29, 2021 (JP) ..... 2021-055746

(51) Int. Cl.
*B65D 41/04* (2006.01)
*B65D 47/12* (2006.01)
*B65D 55/16* (2006.01)

(52) U.S. Cl.
CPC ..... *B65D 41/0421* (2013.01); *B65D 47/123* (2013.01); *B65D 55/16* (2013.01); *B65D 2251/0015* (2013.01); *B65D 2251/0087* (2013.01); *B65D 2251/20* (2013.01)

(58) Field of Classification Search
CPC ..... B65D 81/3841; B65D 47/121; B65D 51/1644; B65D 47/123; B65D 2251/20; B65D 41/04; B65D 41/0421; B65D 43/16
See application file for complete search history.

(56) References Cited

U.S. PATENT DOCUMENTS

| | | | | |
|---|---|---|---|---|
| 8,777,040 | B2 * | 7/2014 | Wahl | B65D 43/16 220/259.3 |
| 11,472,611 | B1 * | 10/2022 | Hove | B65D 41/04 |
| 2011/0198352 | A1 * | 8/2011 | Lown | B65D 47/32 220/254.8 |
| 2018/0162608 | A1 * | 6/2018 | Kim | B65D 51/18 |

FOREIGN PATENT DOCUMENTS

| | | |
|---|---|---|
| JP | 2002068227 | 3/2002 |

* cited by examiner

*Primary Examiner* — Shawn M Braden
(74) *Attorney, Agent, or Firm* — JCIPRNET

(57) ABSTRACT

A plug body includes (a) a spout part, (b) a plug including a fitting part and removably fitted to an inner side of the spout part, and (c) a sealing member in a ring shape attached to a lower side of the fitting part of the plug. When the plug is inserted, the sealing member is in contact with a portion on a lower side of the spout part to form a sealing structure.

3 Claims, 9 Drawing Sheets

PLUG BODY AND BEVERAGE CONTAINER

CROSS-REFERENCE TO RELATED APPLICATION

This application claims the priority benefit of Japan application serial no. 2021-055746, filed on Mar. 29, 2021. The entirety of the above-mentioned patent application is hereby incorporated by reference herein and made a part of this specification.

BACKGROUND

Technical Field

The disclosure relates to a plug body. Further, the disclosure relates to a beverage container attached with the plug body.

Related Art

In the past, a plug body of a beverage container configured in the following manner has been proposed (see, for example, Japanese Patent Application Laid-Open No. 2002-68227). A plug body includes: a cylindrical body made of synthetic resin that is detachably screwed to a female threaded part of an inner peripheral wall of an opening of a container body and protrudes an upper portion upward from the opening of the container body; and a cover body made of synthetic resin that is detachably screwed to the upper portion of the cylindrical body to open and close an opening of the cylindrical body. The cylindrical body is composed of a torso part to be screwed to the female threaded part of an inner container of the container body, a shoulder part continuous with an upper portion of the torso part and protruding upward from the opening of the container body, and a neck part continuous with an upper portion of the shoulder part. A male threaded part for screwing the cover body is formed on a lower outer circumference of the neck part. In the cover body, a female threaded part to be screwed with the male threaded part of the cylindrical body is provided on a lower inner circumference of a peripheral wall. An upper end of the neck part is closed by the cover body via a sealing member.

In the beverage container attached with the plug body as described above, the sealing position is located above an outer side of the screwing position. Therefore, when a relatively high pressure is generated inside the beverage container, the cover body which is a blocking member may be deformed and the sealing structure may not be maintained.

SUMMARY

A plug body according to an embodiment of the disclosure includes a spout part, a plug, and a sealing member. The plug includes a fitting part and is removably fitted to an inner side of the spout part. The sealing member is in a ring shape and is attached to a lower side of the fitting part of the plug. When the plug is inserted, the sealing member is in contact with a portion on a lower side of the spout part to form a sealing structure.

According to the above configuration, the sealing position is located below an inner side of the fitting position. Therefore, even when a relatively high pressure is generated inside the beverage container with the plug body attached to the beverage container, it becomes easier to maintain the sealing structure than in a conventional plug body.

In the plug body according to an embodiment of the disclosure, the spout part may have a cylindrical shape, and the portion on the lower side of the spout part may have a ring shape extending from an inner wall surface toward a cylinder axis.

According to the above configuration, the sealing surface can be widened.

In the plug body according to an embodiment of the disclosure, the fitting part may be a male threaded part formed on an outer circumference of the plug. The spout part may include a cylindrical body and a female threaded part formed on an inner side of the cylindrical body and capable of being screwed with the male threaded part. In a cross-sectional view cut along a plane including a cylinder axis of the cylindrical body, an angle formed by an upper surface of the male threaded part with respect to a plane orthogonal to the cylinder axis may be smaller than an angle formed by a lower surface of the male threaded part with respect to the plane orthogonal to the cylinder axis. An upper surface and a lower surface of the female threaded part may be substantially parallel to the lower surface and the upper surface of the male threaded part.

According to the above configuration, the pressure resistance of the male threaded part can be improved.

In the plug body according to an embodiment of the disclosure, it is possible that the male threaded part is not cut to a sealing position, and the female threaded part is cut to the sealing position.

According to the above configuration, a gap of a thread valley can be formed between the spout part and the plug at a lower portion of the spout part. Therefore, when the gas in the beverage container is about to go out of the beverage container at once through the inside of the spout part at the time of opening the plug, the gas flows not only in the upward direction but also to the gap, and the pressure in the spout part is dispersed. As a result, it is possible to suppress plug popping and noise when opening the plug.

A beverage container according to an embodiment of the disclosure includes the plug body described above and a container in a bottomed cylindrical shape to which the plug body is attached.

According to the above configuration, the sealing position is located below the inner side of the fitting position. Therefore, even when a relatively high pressure is generated inside the beverage container, it becomes easier to maintain the sealing structure than in the conventional plug body.

DESCRIPTION OF THE EMBODIMENTS

An embodiment of the disclosure provides a plug body which makes it easier to maintain a sealing structure than in a conventional plug body even when a relatively high pressure is generated inside a beverage container. Hereinafter the embodiment of the disclosure will be described in detail with reference to the drawings.

<Configuration of Beverage Container According to the Embodiment of the Disclosure>

As shown in FIG. 1, FIG. 2, FIG. 4, and FIG. 5, a beverage container 10 according to the embodiment of the disclosure is composed of a double-layer vacuum container 200, a plug body 100, a second packing PK2, and a strap 300. Hereinafter, these components will be described in detail. The beverage container 10 is assembled by attaching the plug body 100 to the double-layer vacuum container 200.

1. Double-Layer Vacuum Container

Figure 4:
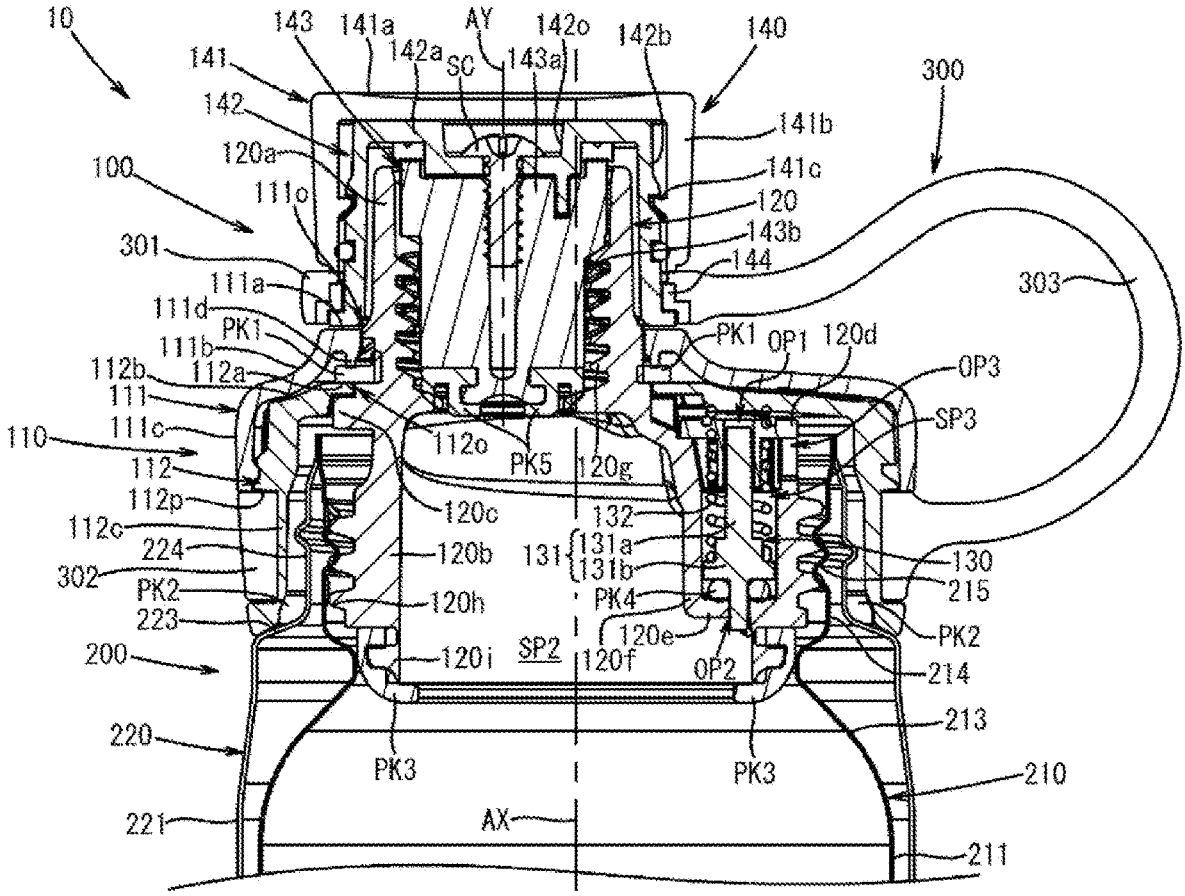
FIG. 4 is a cross-sectional view taken along line A-A of FIG. 3. In this figure, illustration of a double-layer vacuum container is partially omitted, and a state in which the pressure adjustment mechanism is not acting is shown.
Figure 5:
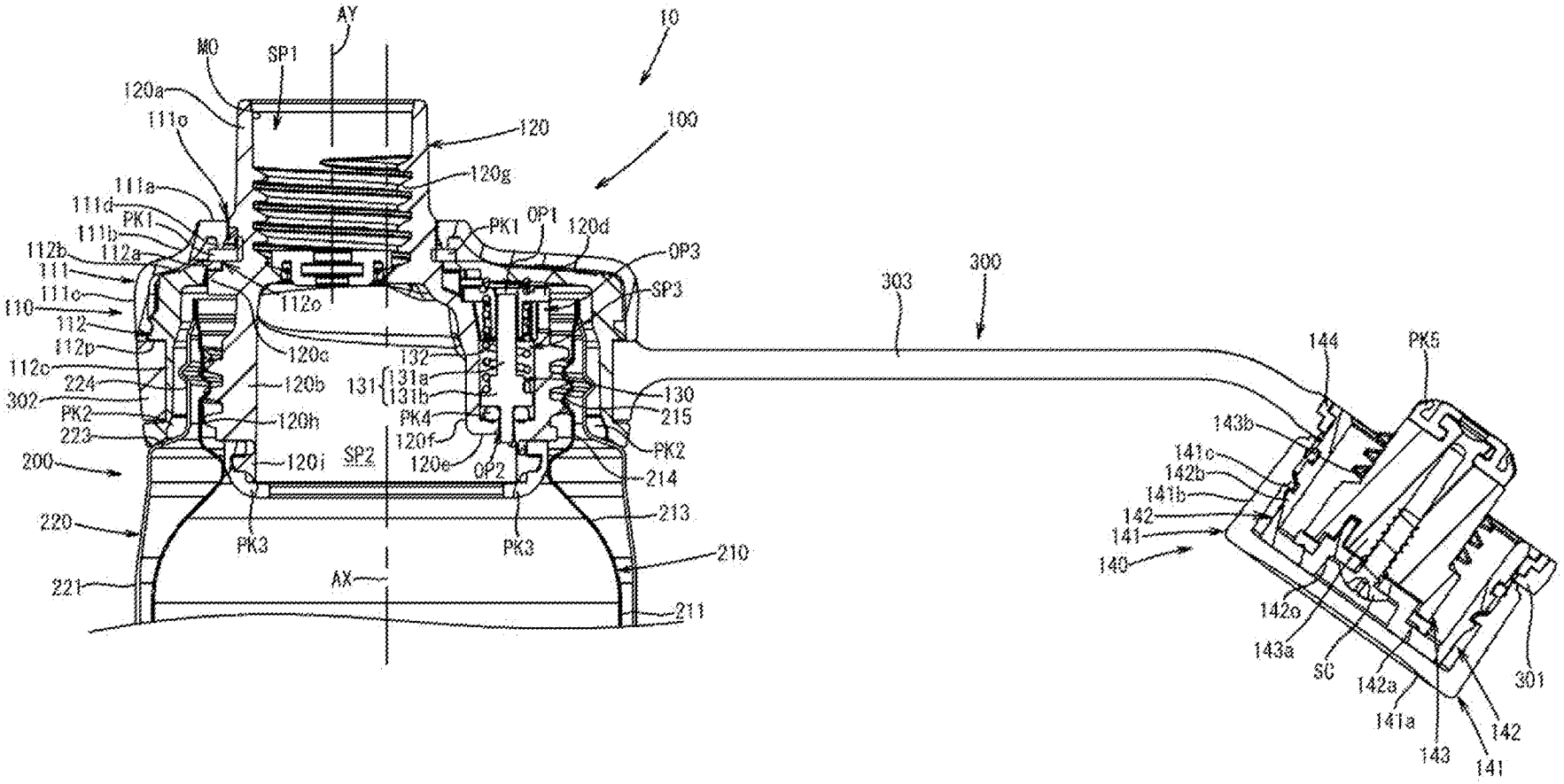
FIG. 5 is a cross-sectional view taken along line A-A in FIG. 3 when the outlet of the cylindrical wall part is not blocked by the plug. In this figure, illustration of the double-layer vacuum container is partially omitted, and a state in which the pressure adjustment mechanism is not acting is shown.

The double-layer vacuum container 200 is a container made of metal such as stainless steel, and as shown in FIG. 1, FIG. 2, FIG. 4, and FIG. 5, is mainly formed of an inner cylinder 210 and an outer cylinder 220. Specifically, as shown in FIG. 4 to FIG. 6, after an upper end portion of a tip wall part 214 (to be described later) of the inner cylinder 210 and an upper end portion of a tip wall part 224 (to be described later) of the outer cylinder 220 are joined together so that a heat insulating space is formed between the inner cylinder 210 and the outer cylinder 220, a vacuum state is created in the heat insulating space, and the double-layer vacuum container 200 is thus formed.

Figure 6:
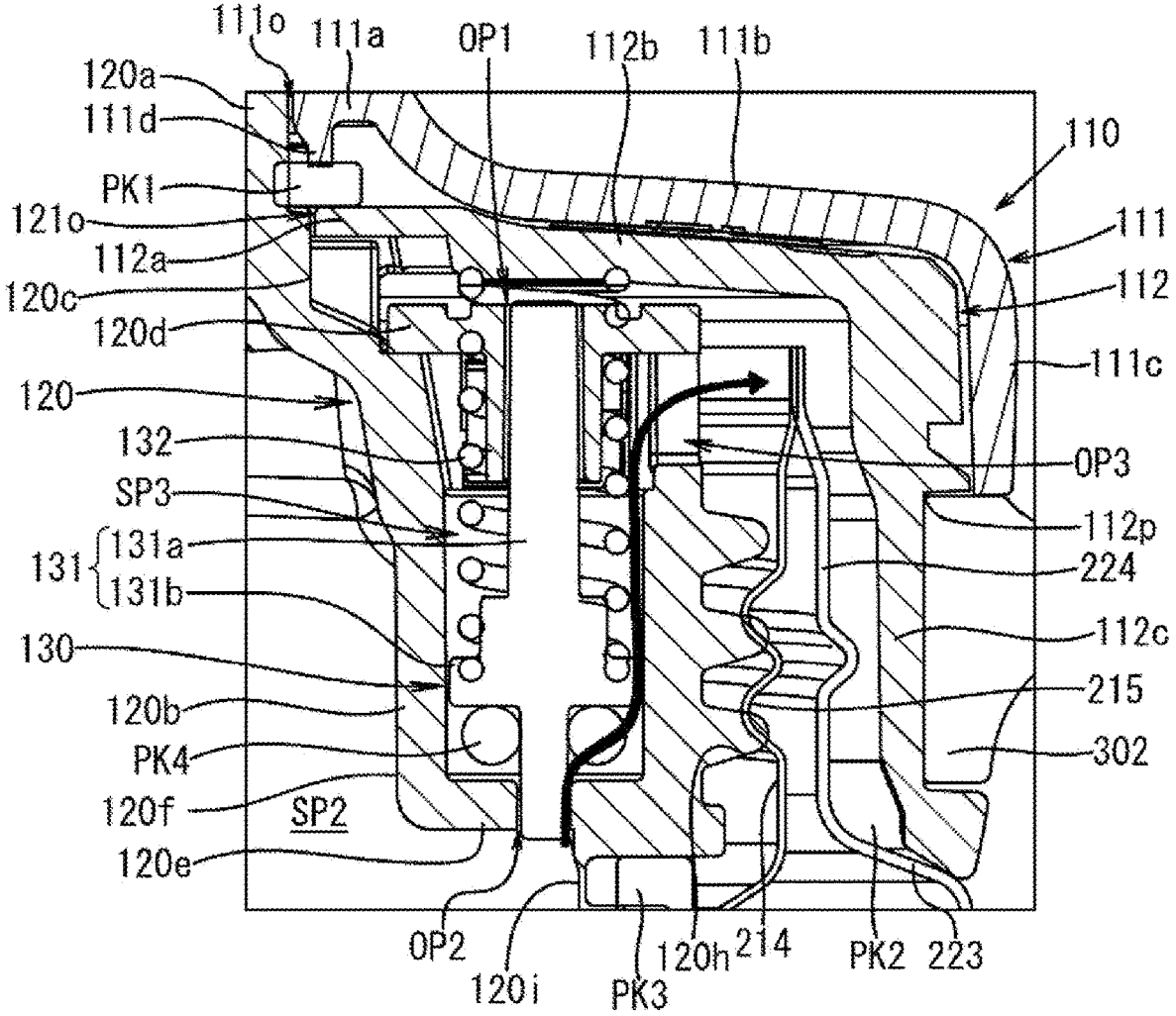
FIG. 6 is an enlarged cross-sectional view of the vicinity of the pressure adjustment mechanism according to the embodiment of the disclosure. In this figure, a state in which the pressure adjustment mechanism is acting is shown.
Figure 7:
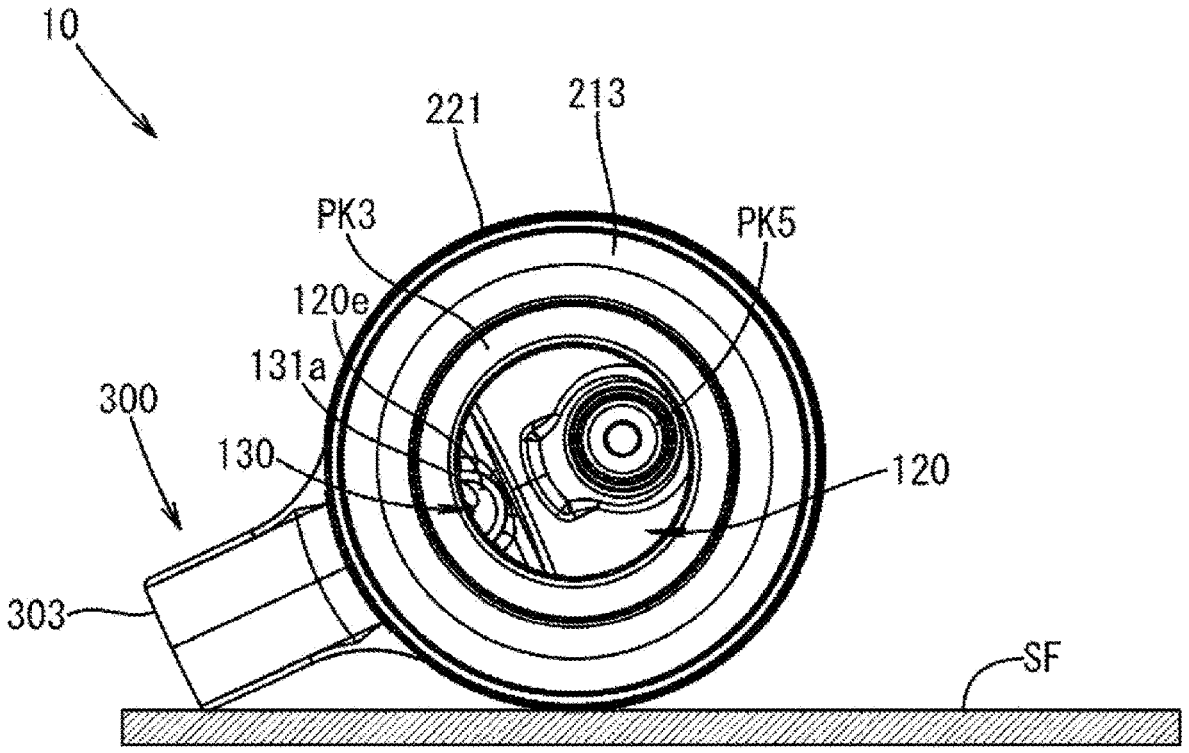
FIG. 7 is a view of an example of the beverage container when rolled over according to the embodiment of the disclosure. In this figure, the beverage container is cut at a height slightly below a step part of an inner cylinder in the beverage container in the state shown in FIG. 1.

As shown in FIG. 4 to FIG. 6, the inner cylinder 210 is mainly formed of an inner cylinder sidewall part 211, an inner cylinder bottom wall part (not shown), a step part 213, a tip wall part 214, and a female threaded part 215. The inner cylinder sidewall part 211 has a substantially cylindrical shape. The inner cylinder bottom wall part has a central portion spherically raised toward an opening side (upper side) and a corner portion having a recessed arc shape. The inner cylinder bottom wall part is formed at a lower side of the inner cylinder sidewall part 211. The step part 213 is a portion having a truncated cone shape (conical frustum shape), and as shown in FIG. 4, FIG. 5, and FIG. 7, is formed between the inner cylinder sidewall part 211 and the tip wall part 214 and connects the inner cylinder sidewall part 211 and the tip wall part 214. The tip wall part 214 has a substantially cylindrical shape, and as shown in FIG. 4 to FIG. 6, extends upward from an upper end portion of the step part 213. As shown in FIG. 4 to FIG. 6, the female threaded part 215 is formed on an inner peripheral surface of the tip wall part 214 and may be screwed with a male threaded part 120*h* (to be described later) of a cylindrical wall part 120 of the plug body 100.

Figure 1:
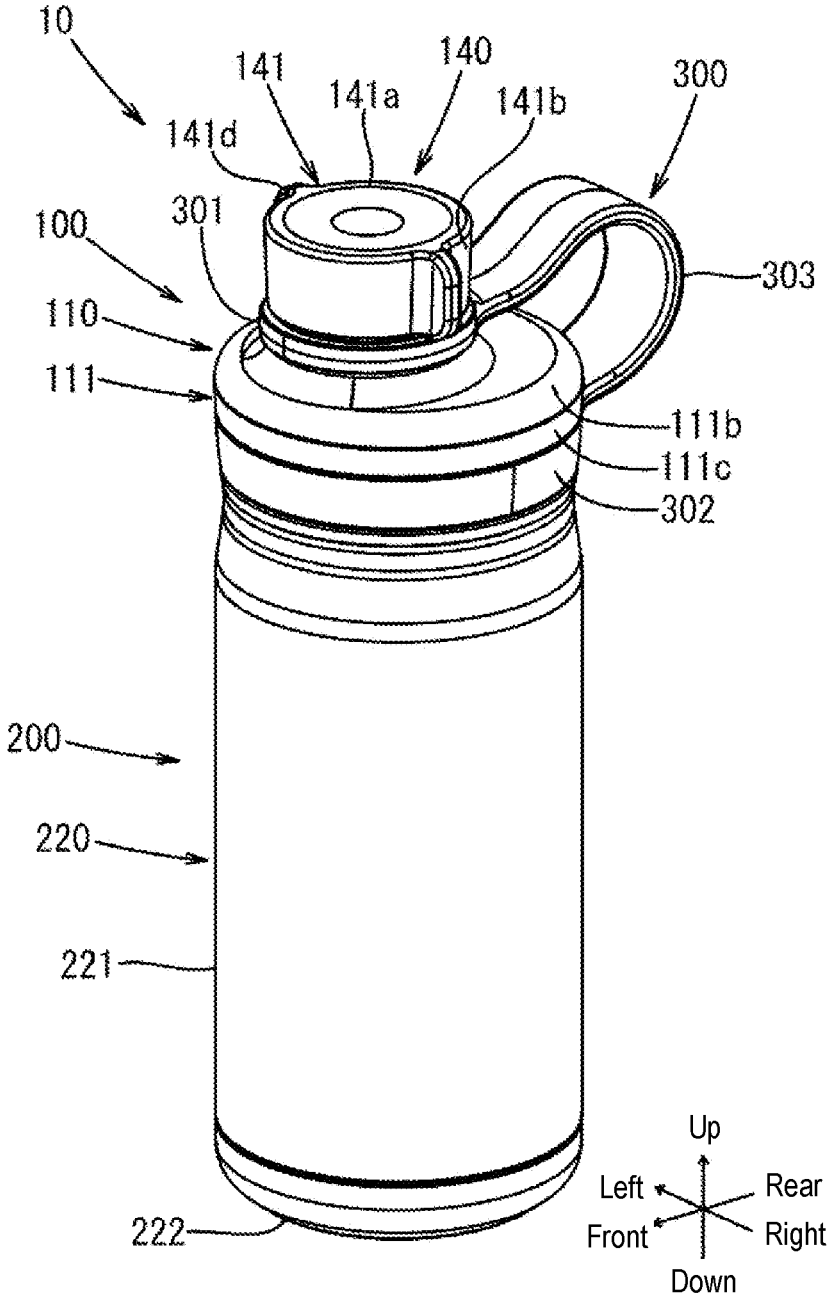
FIG. 1 is a perspective view of a beverage container according to an embodiment of the disclosure. In this figure, an outlet of a cylindrical wall part is blocked by a plug.
Figure 2:
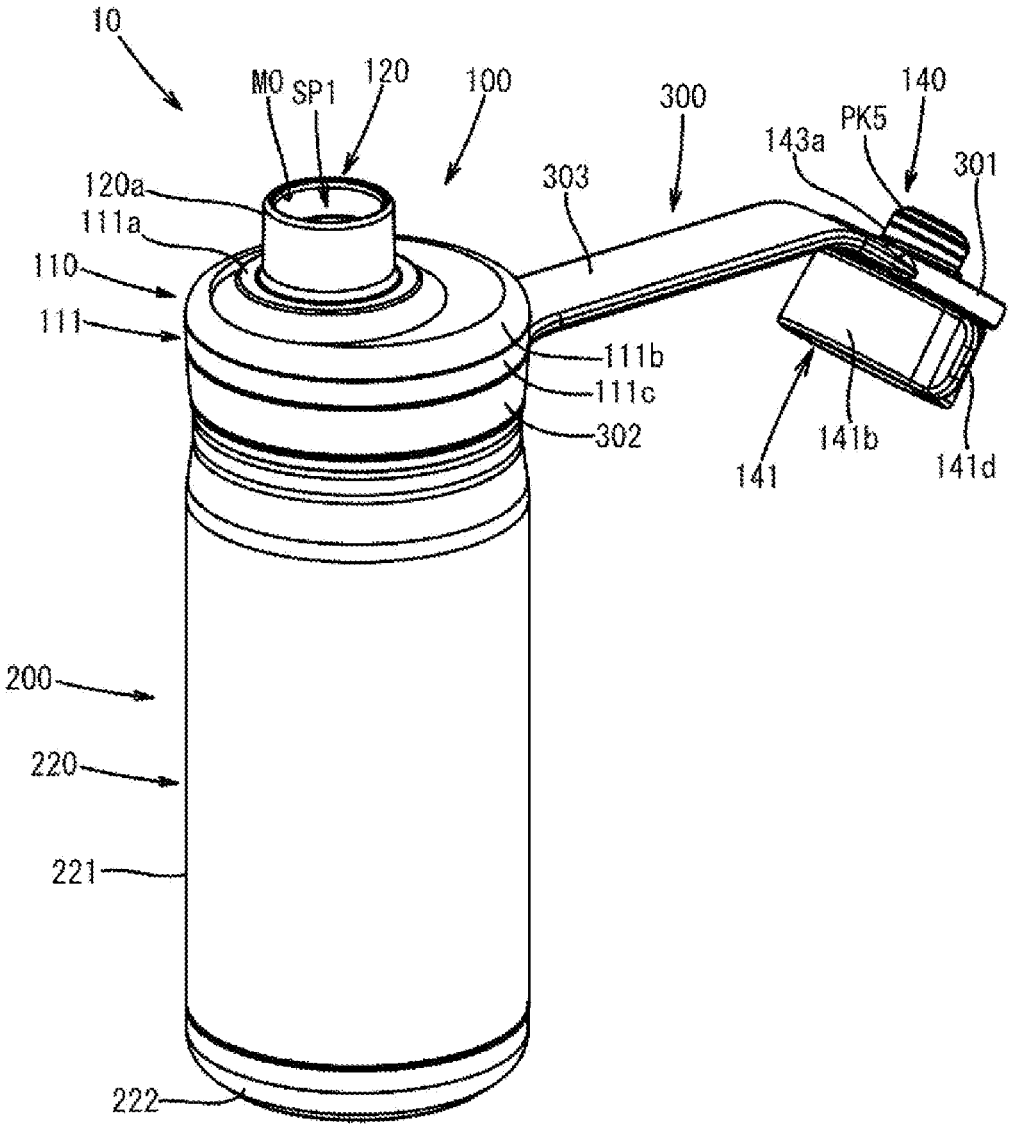
FIG. 2 is a perspective view of the beverage container according to the embodiment of the disclosure. In this figure, the outlet of the cylindrical wall part is not blocked by the plug.
Figure 3:
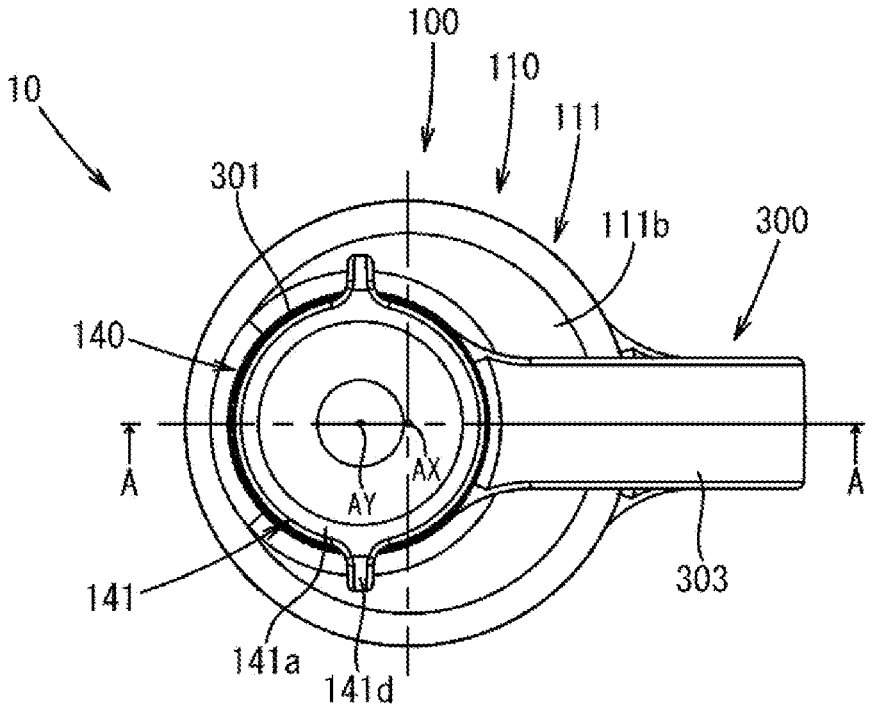
FIG. 3 is a plan view of the beverage container according to the embodiment of the disclosure. In this figure, the outlet of the cylindrical wall part is blocked by the plug.

As shown in FIG. 1, FIG. 2, and FIG. 4 to FIG. 6, the outer cylinder 220 is mainly formed of an outer cylinder sidewall part 221, an outer cylinder bottom wall part 222, a step part 223, and a tip wall part 224. The outer cylinder sidewall part 221 has a substantially cylindrical shape similar to the inner cylinder sidewall part 211. The outer cylinder bottom wall part 222 has a substantially disk shape, and as shown in FIG. 1 and FIG. 2, is joined with a lower end portion of the outer cylinder sidewall part 221. The step part 223 is a portion having a truncated cone shape (conical frustum shape), and as shown in FIG. 4 to FIG. 6, is formed between the outer cylinder sidewall part 221 and the tip wall part 224 and connects the outer cylinder sidewall part 221 and the tip wall part 224. The tip wall part 224 has a substantially cylindrical shape, and as shown in FIG. 4 to FIG. 6, extends upward from an upper end portion of the step part 223. As shown in FIG. 4 to FIG. 6, the second packing PK2 (to be described later) is attached to a recess formed by the step part 223 and the tip wall part 224.

2. Plug Body

As shown in FIG. 1 to FIG. 5, the plug body 100 is mainly composed of a shoulder member 110, a cylindrical wall part 120, a pressure adjustment mechanism 130, and a plug 140. Hereinafter, these components will be described in detail.

(1) Shoulder Member

The shoulder member 110 is a member formed of a resin or the like, and as shown in FIG. 1 to FIG. 6, covers the pressure adjustment mechanism 130 and is mainly composed of an outer shoulder member 111 and an inner shoulder member 112. Hereinafter, these components will be described in detail.

(1-1) Outer Shoulder Member

Figure 9:
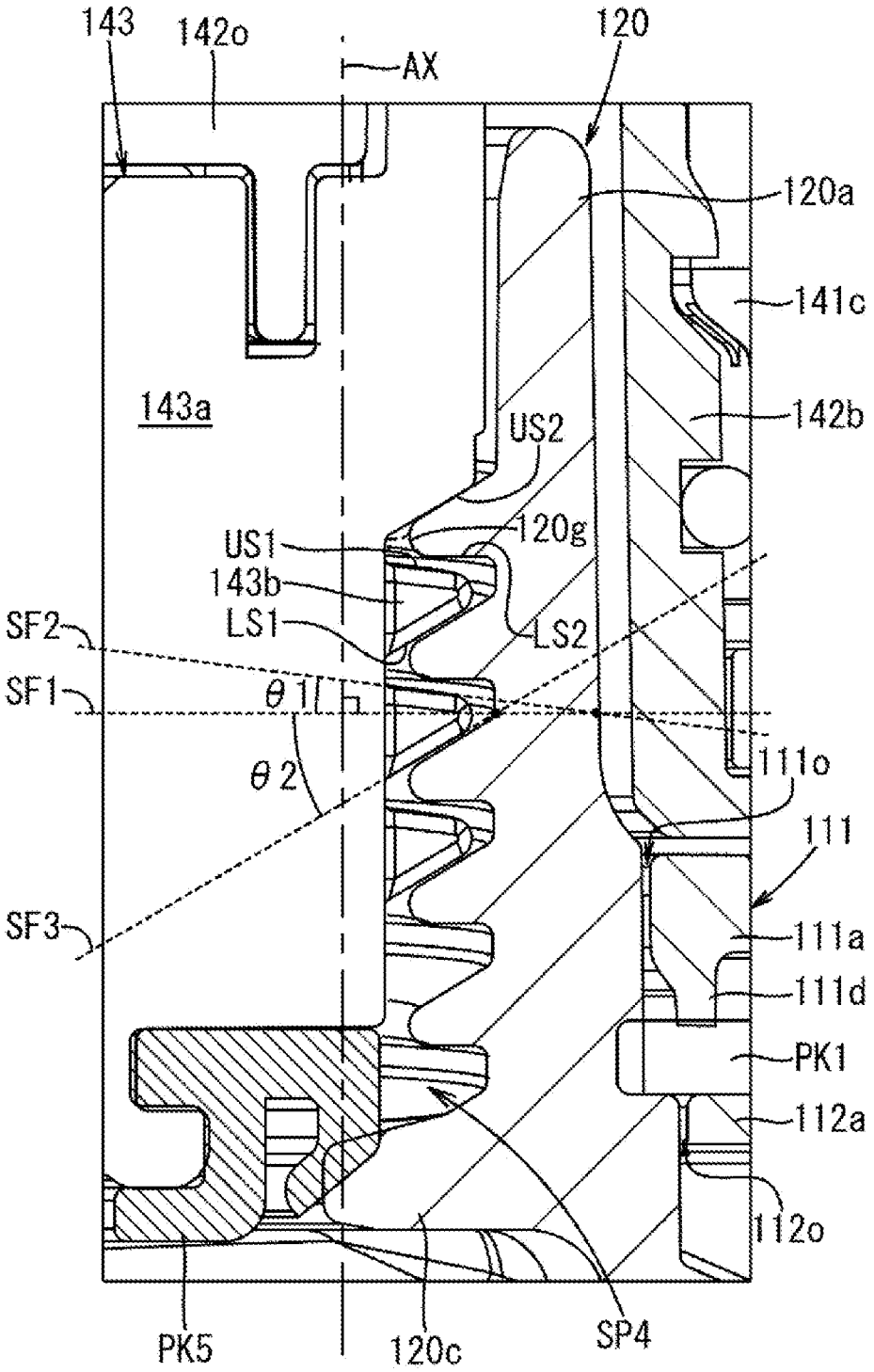
FIG. 9 is an enlarged cross-sectional view of the vicinity of a female threaded part of the cylindrical wall part and a male threaded part of the plug in FIG. 4.

As shown in FIG. 1 to FIG. 6, the outer shoulder member 111 is mainly formed of a top wall part 111*a*, a step part 111*b*, a sidewall part 111*c*, and a claw part 111*d*. The top wall part 111*a* is a substantially disk-shaped portion constituting an upper wall of the outer shoulder member 111, and as shown in FIG. 2, FIG. 4 to FIG. 6, and FIG. 9, an opening 111*o* in a circular shape is formed at a central portion. As shown in FIG. 4 and FIG. 9, an upper sidewall part 120*a* of the cylindrical wall part 120 is inserted into the opening 111*o*. As shown in FIG. 1 to FIG. 6, the step part 111*b* is formed between the top wall part 111*a* and the sidewall part 111*c* and connects the top wall part 111*a* and the sidewall part 111*c*. The sidewall part 111*c* has a substantially cylindrical shape, and as shown in FIG. 1, FIG. 2, and FIG. 4 to FIG. 6, extends downward from a lower end portion of the step 111*b* to an upper end position of a recess 112*p* of a sidewall part 112*c* of the inner shoulder member 112. As shown in FIG. 4 to FIG. 6 and FIG. 9, the claw part 111*d* is a protrusion extending downward from an inner edge portion (i.e., a circumferential portion of the opening 111*o*) of the top wall part 111*a*, and clamps a first packing PK1 (to be described later) in cooperation with a top wall part 112*a* (to be described later) of the inner shoulder member 112.

(1-2) Inner Shoulder Member

As shown in FIG. 4 to FIG. 6, the inner shoulder member 112 is mainly formed of a top wall part 112*a*, a step part 112*b*, and a sidewall part 112*c*. The top wall part 112*a* is a substantially disk-shaped portion constituting an upper wall of the inner shoulder member 112, and as shown in FIG. 4 to FIG. 6 and FIG. 9, an opening 112*o* in a circular shape is formed at a central portion. As shown in FIG. 4 and FIG. 9, the upper sidewall part 120*a* of the cylindrical wall part 120 is inserted into the opening 112*o*. As shown in FIG. 4 to FIG. 6, a diameter of the opening 112*o* is slightly larger than a diameter of the opening 111*o* of the outer shoulder member 111, and in a plan perspective view, a region of the opening 112*o* overlaps with an entire region of the opening 111*o* of the outer shoulder member 111. Further, in a plan view, a center of the opening 112*o* is located at the same position as a center of the opening 111*o* of the outer shoulder member 111. As shown in FIG. 4 to FIG. 6, the step part 112*b* is formed between the top wall part 112*a* and the sidewall part 112*c* and connects the top wall part 112*a* and the sidewall part 112*c*. The sidewall part 112*c* has a substantially cylindrical shape, and as shown in FIG. 4 to FIG. 6, extends downward from a lower end portion of the step part 112*b*. As shown in FIG. 4 to FIG. 6, a recess 112*p* in a ring shape recessed inward is formed from a lower portion to a middle portion of the sidewall part 112*c*. A large ring part 302 (to be described later) of the strap 300 is fitted into the recess 112*p*.

(2) Cylindrical Wall Part

The cylindrical wall part 120 is a member formed of a resin or the like, and as shown in FIG. 2 and FIG. 4 to FIG. 6, has a portion protruding upward through the opening 111*o* of the outer shoulder member 111 and the opening 112*o* of the inner shoulder member 112, and is mainly formed of an upper sidewall part 120*a*, a lower sidewall part 120*b*, a collar part 120*c*, an upper containment wall part 120*d*, a lower containment wall part 120*e*, a front containment wall part 120*f*, a female threaded part 120*g*, a male threaded part 120*h*, and a third packing attachment wall part 120*i*. Further, as shown in FIG. 4 to FIG. 6, the first packing PK1 and the third packing PK3 are attached to the cylindrical wall part 120. The upper sidewall part 120*a* has a substantially cylindrical shape. As shown in FIG. 2, FIG. 4, FIG. 5, and FIG. 9, the female threaded part 120*g* is formed from a lower portion to a middle portion of an inner peripheral surface of the upper sidewall part 120*a*. Further, as shown in FIG. 2 and FIG. 5, an internal space SP1 of the upper sidewall part 120*a* functions as a beverage passage together with an internal space SP2 (to described later), and the upper sidewall part 120*a* functions as a spout as an opening at an upper side of the upper sidewall part 120*a* becomes an outlet MO of the beverage. The lower sidewall part 120*b* has a substantially cylindrical shape. As shown in FIG. 4 and FIG. 5, the male threaded part 120*h* is formed from a lower portion to a middle portion of an outer peripheral surface of the lower sidewall part 120*b*. Further, as shown in FIG. 4 and FIG. 6, a notch is formed at an upper end portion on a rear side of the lower sidewall part 120*b*, and an opening OP3 is formed by arranging the upper containment wall part 120*d* on an upper side of the notch. As shown in FIG. 4 to FIG. 6 and FIG. 9, the collar part 120*c* extends outward and inward (a cylinder axis line AY of the upper sidewall part 120*a*) from a boundary between the upper sidewall part 120*a* and the lower sidewall part 120*b* and has a substantially ring shape. An outer portion of the collar part 120*c* supports the top wall part 112*a* of the inner shoulder member 112, and an inner portion functions as a sealing portion of the plug 140. The cylinder axis line AY of the upper sidewall part 120*a* is a virtual line extending in the vertical direction from a center of the upper sidewall part 120*a* in a plan view (see FIG. 3 to FIG. 5). The upper containment wall part 120*d* has a substantially disk shape, and as shown in FIG. 4 to FIG. 6, is formed on an upper side of a rear portion of the lower sidewall part 120*b*. As shown in FIG. 4 to FIG. 6, an opening OP1 is formed at a central portion of the upper containment wall part 120*d*. The lower containment wall part 120*e* has a substantially disk shape, and as shown in FIG. 4 to FIG. 6, is formed on a lower side of the rear portion of the lower sidewall part 120*b*. As shown in FIG. 4 to FIG. 6, an opening OP2 is formed at a central portion of the lower containment wall part 120*e*. The front containment wall part 120*f* has a partial circular shape in a plan view, and as shown in FIG. 4 to FIG. 6, extends upward from a front edge portion of the lower containment wall part 120*e*. Herein, as shown in FIG. 4 to FIG. 6, a cylindrical portion having an internal space SP3 is formed by the lower sidewall part 120*b*, the upper containment wall part 120*d*, the lower containment wall part 120*e*, and the front containment wall part 120*f*. As shown in FIG. 4 to FIG. 6, the internal space SP3 extends in the vertical direction. Further, as shown in FIG. 4 to FIG. 6, the pressure adjustment mechanism 130 (to be described later) is arranged in the internal space SP3. The female threaded part 120*g* may be screwed with a male threaded part 143*b* (to be described later) of the plug 140, and as described above, is formed from the lower portion to the middle portion of the inner peripheral surface of the upper sidewall part 120*a*. In other words, the female threaded part 120*g* is cut to a position at which a fifth packing PK5 of the plug 140 and the inner portion of the collar part 120*c* are in contact with each other when screwed with the male threaded part 143*b* of the plug 140 (see FIG. 4 and FIG. 9). As described above, the male threaded part 120*h* is formed from the lower portion to the middle portion of the outer peripheral surface of the lower sidewall part 120*b* and may be screwed with the female threaded part 215 of the inner cylinder 210. The third packing attachment wall part 120*i* has a substantially cylindrical shape, and as shown in FIG. 4 to FIG. 6, is formed on a lower side of the lower sidewall part 120*b*. Herein, as shown in FIG. 4 to FIG. 6, the internal space SP2 is formed by the lower sidewall part 120*b*, the lower containment wall part 120*e*, the front containment wall part 120*f*, and the third packing attachment wall part 120*i*. The internal space SP2 functions as a beverage passage together with the internal space SP1 of the upper sidewall part 120*a*, and also functions as a space for retaining air on an upper side of the beverage when the plug body 100 is attached to the double-layer vacuum container 200 and the beverage is poured into the double-layer vacuum container 200. The first packing PK1 is a ring-shaped member formed of an elastic material such as rubber or an elastomer, and as shown in FIG. 4 to FIG. 6 and FIG. 9, is attached to a lower portion of an outer peripheral surface of the upper sidewall part 120*a* of the cylindrical wall part 120. Further, as described above, the first packing PK1 is clamped between the claw part 111*d* of the outer shoulder member 111 of the shoulder member 110 and the top wall part 112*a* of the inner shoulder member 112 of the shoulder member 110. Herein, the first packing PK1 serves to close a gap between the outer shoulder member 111 of the shoulder member 110 and the upper sidewall part 120*a* of the cylindrical wall part 120, and close a gap between the inner shoulder member 112 of the shoulder member 110 and the upper sidewall part 120*a* of the cylindrical wall part 120. The third packing PK3 is a ring-shaped member formed of an elastic material such as rubber or an elastomer, and as shown in FIG. 4 to FIG. 7, is attached to an outer peripheral surface of the third packing attachment wall part 120*i*. Herein, when the male threaded part 120*h* is screwed with the female threaded part 215 of the inner cylinder 210 of the double-layer vacuum container 200, the third packing PK3 is in contact with the upper end portion of the step part 213 of the inner cylinder 210, as shown in FIG. 4 and FIG. 5. In such a case, the third packing PK3 serves to close a gap between the cylindrical wall part 120 and the inner cylinder 210.

(3) Pressure Adjustment Mechanism

The pressure adjustment mechanism 130 is a member for adjusting an internal pressure of the beverage container 10, and as shown in FIG. 4 to FIG. 6, is arranged in the internal space SP3 of the cylindrical wall part 120 and is mainly composed of a valve body 131, an urging member 132, and a fourth packing PK4. Hereinafter, these components will be described in detail.

(3-1) Valve Body

As shown in FIG. 4 to FIG. 6, the valve body 131 is mainly formed of a valve rod 131*a* and a valve part 131*b*. As shown in FIG. 4 to FIG. 6, the valve rod 131*a* is a rod member having a substantially columnar shape extending in the vertical direction. Herein, as shown in FIG. 4 to FIG. 6, the valve rod 131*a* is inserted inside the urging member 132, and an upper end portion of the valve rod 131*a* is inserted through the opening OP1 of the upper containment wall part 120*d* of the cylindrical wall part 120. On the other hand, a lower end portion of the valve rod 131*a* is inserted through the opening OP2 of the lower containment wall part 120*e* of the cylindrical wall part 120. A slight gap is formed between the lower end portion of the valve rod 131*a* and the opening OP2. As shown in FIG. 4 to FIG. 6, the valve part 131*b* is a substantially columnar portion formed at the lower end portion of the valve rod 131*a* and is urged toward a lower side (i.e., the opening OP2 side) by the urging member 132 (as a result, the valve rod 131*a* is also urged toward the lower side by the urging member 132). In a plan view, a diameter of the valve part 131*b* is designed to be larger than an outer diameter of the fourth packing PK4. Further, in the internal space SP3, a slight gap is formed between the valve part 131*b* and the lower sidewall part 120*b* and the front containment wall part 120*f* of the cylindrical wall part 120.

(3-2) Urging Member

The urging member 132 is a coil spring for urging the valve body 131 downward. As shown in FIG. 4 to FIG. 6, one end of the urging member 132 is fitted into the upper containment wall part 120*d* of the cylindrical wall part 120, and another end of the urging member 132 is in contact with the valve part 131*b* of the valve body 131.

(3-3) Fourth Packing

The fourth packing PK4 is a ring-shaped member formed of an elastic material such as rubber or an elastomer. Further, as shown in FIG. 4 to FIG. 6, the fourth packing PK4 is attached to a lower surface of the valve part 131*b* of the valve body 131 so that a lower portion of the valve rod 131*a* of the valve body 131 passes through a central opening of the fourth packing PK4. Herein, as shown in FIG. 4, when the valve body 131 is urged downward by the urging member 132, the fourth packing PK4 is in contact with an upper surface of the lower containment wall part 120*e* of the cylindrical wall part 120 and blocks the opening OP2 of the lower containment wall part 120*e* of the cylindrical wall part 120 together with the valve body 131.

In the plug body 100 according to the embodiment of the disclosure, a mass of a front side portion is designed to be larger than a mass of a rear side portion. Specifically, this design is realized by making a mass of the upper sidewall part 120*a* of the cylindrical wall part 120 larger than a mass of the pressure adjustment mechanism 130. With this design, when the plug body 100 is attached to the double-layer vacuum container 200, in the beverage container 10, a mass on a front side of a cylinder axis line AX (referring to FIG. 3 to FIG. 5 and FIG. 9, it is a virtual line extending in the vertical direction from centers of the inner cylinder bottom wall part of the inner cylinder 210 and the outer cylinder bottom wall part 222 of the outer cylinder 220 and is parallel to the cylinder axis line AY of the upper sidewall part 120*a* of the cylindrical wall part 120) of the double-layer vacuum container 200 is larger than a mass on a rear side of the cylinder axis line AX. In other words, when the plug body 100 is attached to the double-layer vacuum container 200, if the beverage container 10 is tilted by a certain amount or more or rolled over, the pressure adjustment mechanism 130 will be located above the cylindrical wall part 120. At this time, if the beverage has been poured into the double-layer vacuum container 200, the beverage flows into the internal space SP2, and the air stored in the internal space SP2 moves to the pressure adjustment mechanism 130 side. Further, as shown in FIG. 4 and FIG. 5, the pressure adjustment mechanism 130 is located on an opposite side of portions, except a rear portion, of the upper sidewall part 120*a* of the cylindrical wall part 120 across the cylinder axis line AX of the double-layer vacuum container 200.

(4) Plug

The plug 140 is a member for blocking the outlet MO of the upper sidewall part 120*a* of the cylindrical wall part 120, and as shown in FIG. 1 to FIG. 5 and FIG. 8, is mainly composed of an upper cover member 141, a lower cover member 142, a plug main body part 143, and a rotating ring 144. Hereinafter, these components will be described in detail. As shown in FIG. 2 and FIG. 5, when the plug 140 does not block the outlet MO of the upper sidewall part 120*a* of the cylindrical wall part 120, the plug 140 may be located on a rear side (rear side of the double-layer vacuum container 200) of the shoulder member 110 due to the strap 300.

(4-1) Upper Cover Member

The upper cover member 141 is a member formed of a resin or the like, and as shown in FIG. 1 to FIG. 5 and FIG. 8, is mainly formed of a top wall part 141*a*, a sidewall part 141*b*, a claw part 141*c*, and a handle part 141*d*. As shown in FIG. 1 to FIG. 5, the top wall part 141*a* has a substantially disk shape. As shown in FIG. 1, FIG. 2, FIG. 4, FIG. 5, and FIG. 8, the sidewall part 141*b* has a substantially cylindrical shape and extends downward from an outer edge portion of the top wall part 141*a*. As shown in FIG. 4, FIG. 5, and FIG. 9, the claw part 141*c* extends inward from a middle portion of an inner peripheral surface of the sidewall part 141*b* and is fitted into a recess formed at a middle portion of an outer peripheral surface of a sidewall part 142*b* of the lower cover member 142. The handle part 141*d* is used by the user when turning the upper cover member 141, and as shown in FIG. 1 to FIG. 3 and FIG. 8, extends outward from an outer peripheral surface of the sidewall part 141*b* on a diameter line passing through a center of the top wall part 141*a*.

(4-2) Lower Cover Member

The lower cover member 142 is a member formed of a resin or the like, and as shown in FIG. 4 and FIG. 5, is mainly formed of a top wall part 142*a* and a sidewall part 142*b*. As shown in FIG. 4 and FIG. 5, the top wall part 142*a* has a substantially disk shape. As shown in FIG. 4 and FIG. 5, a recess 142*o* recessed downward is formed at a central portion of the top wall part 142*a*, and an opening is formed at a central portion of the recess 142*o*. Then, as shown in FIG. 4 and FIG. 5, the lower cover member 142 and the plug main body part 143 are fastened by passing a screw SC through this opening and an insertion hole (to be described later) of the plug main body part 143. As shown in FIG. 4, FIG. 5, FIG. 8, and FIG. 9, the sidewall part 142*b* has a substantially cylindrical shape and extends downward from an outer edge portion of the top wall part 142*a*. As described above, a recess is formed at the middle portion of the outer peripheral surface of the sidewall part 142*b*, and the claw part 141*c* of the upper cover member 141 is fitted thereto.

(4-3) Plug Main Body Part

The plug main body part 143 is a member detachably attached to the internal space SP1 of the cylindrical wall part 120, and as shown in FIG. 4, FIG. 5, FIG. 8, and FIG. 9, is formed of a main body part 143*a*, a male threaded part 143*b*, and a fifth packing PK5. The main body part 143*a* is formed of a resin or the like, and as shown in FIG. 2, FIG. 4, FIG. 5, FIG. 8, and FIG. 9, has a substantially columnar shape. As shown in FIG. 4 and FIG. 5, the main body part 143*a* is formed with an insertion hole extending downward from a central portion of an upper wall part of the main body part 143*a*. As described above, the lower cover member 142 and the plug main body part 143 are fastened by passing the screw SC through this insertion hole and the opening of the top wall part 142*a* of the lower cover member 142. The male threaded part 143*b* is formed of a resin or the like, and as described above, may be screwed with the female threaded part 120*g* of the cylindrical wall part 120. As shown in FIG. 4, FIG. 5, FIG. 8, and FIG. 9, the male threaded part 143*b* is formed at a middle portion of an outer peripheral surface of the main body part 143*a*. In other words, the male threaded part 143*b* is not cut to a position at which the fifth packing PK5 and the inner portion of the collar part 120*c* of the cylindrical wall part 120 are in contact with each other when screwed with the female threaded part 120*g* of the cylindrical wall part 120 (see FIG. 4 and FIG. 9). The fifth packing PK5 is a ring-shaped member formed of an elastic material such as rubber or an elastomer, and as shown in FIG. 2, FIG. 4, FIG. 5, and FIG. 7 to FIG. 9, is attached to a lower end portion of the main body part 143*a*. Herein, when the male threaded part 143*b* is screwed with the female threaded part 120*g* of the cylindrical wall part 120, as shown in FIG. 4 and FIG. 9, the fifth packing PK5 is in contact with the inner portion of the collar part 120*c* of the cylindrical wall part 120 and serves to close a gap between the main body part 143*a* and the cylindrical wall part 120. Further, as shown in FIG. 4 and FIG. 9, the contact position between the fifth packing PK5 and the inner portion of the collar part 120*c* of the cylindrical wall part 120 is below an inner side of the screwing position between the male threaded part 143*b* and the female threaded part 120*g* of the cylindrical wall part 120.

Herein, the male threaded part 143*b* of the plug 140 and the female threaded part 120*g* of the cylindrical wall part 120 will be described with reference to FIG. 9. When the male threaded part 143*b* of the plug 140 is screwed with the female threaded part 120*g* of the cylindrical wall part 120, the male threaded part 143*b* of the plug 140 does not reach a lower portion of the female threaded part 120*g* of the cylindrical wall part 120. This is because when an upper portion of the plug main body part 143 of the plug 140 is in contact with an upper end portion of the female threaded part 120*g* of the cylindrical wall part 120 (i.e., when the plug 140 is completely attached to the cylindrical wall part 120), the plug 140 cannot move downward, and the male threaded part 143*b* of the plug 140 is fastened at a position at which it is screwed with an upper portion and a middle portion of the female threaded part 120*g* of the cylindrical wall part 120. Therefore, with the male threaded part 143*b* of the plug 140 screwed with the female threaded part 120*g* of the cylindrical wall part 120, a thread valley space SP4 is formed between the upper sidewall part 120*a* of the cylindrical wall part 120 and the plug main body part 143 of the plug 140. Further, with the male threaded part 143*b* of the plug 140 screwed with the female threaded part 120*g* of the cylindrical wall part 120, an upper surface US1 of the male threaded part 143*b* of the plug 140 is substantially parallel to a lower surface LS2 of the female threaded part 120*g* of the cylindrical wall part 120, and a lower surface LS1 of the male threaded part 143*b* of the plug 140 is parallel to an upper surface US2 of the female threaded part 120*g* of the cylindrical wall part 120. Next, in a cross-sectional view cut along a plane including the cylinder axis line AY of the upper sidewall part 120*a* (in FIG. 9, also including the cylinder axis line AX of the double-layer vacuum container 200), a plane orthogonal to the cylinder axis line AY (in FIG. 9, the cylinder axis line AX of the double-layer vacuum container 200 parallel to the cylinder axis line AY) of the upper sidewall part 120*a* of the cylindrical wall part 120 is defined as a plane SF1, a plane obtained by extending the upper surface US1 of the male threaded part 143*b* of the plug 140 is defined as a plane SF2, a plane obtained by extending the lower surface LS1 of the male threaded part 143*b* of the plug 140 is defined as a plane SF3, an angle formed by the upper surface US1 (i.e., the plane SF2) of the male threaded part 143*b* of the plug 140 with respect to the plane SF1 is defined as an angle θ1, and an angle formed by the lower surface LS1 (i.e., the plane SF3) of the male threaded part 143*b* of the plug 140 with respect to the plane SF1 is defined as an angle θ2. The male threaded part 143*b* of the plug 140 is designed so that the angle θ1 is smaller than the angle θ2.

Further, in the beverage container 10 according to the embodiment of the disclosure, an outer diameter of the fifth packing PK5 of the plug main body part 143 of the plug 140 is smaller than an inner diameter of an upper end portion of the upper sidewall part 120*a* of the cylindrical wall part 120 and an inner diameter of the upper end portion of the step part 213 of the inner cylinder 210 (see FIG. 4 and FIG. 5).

(4-4) Rotating Ring

Figure 8:
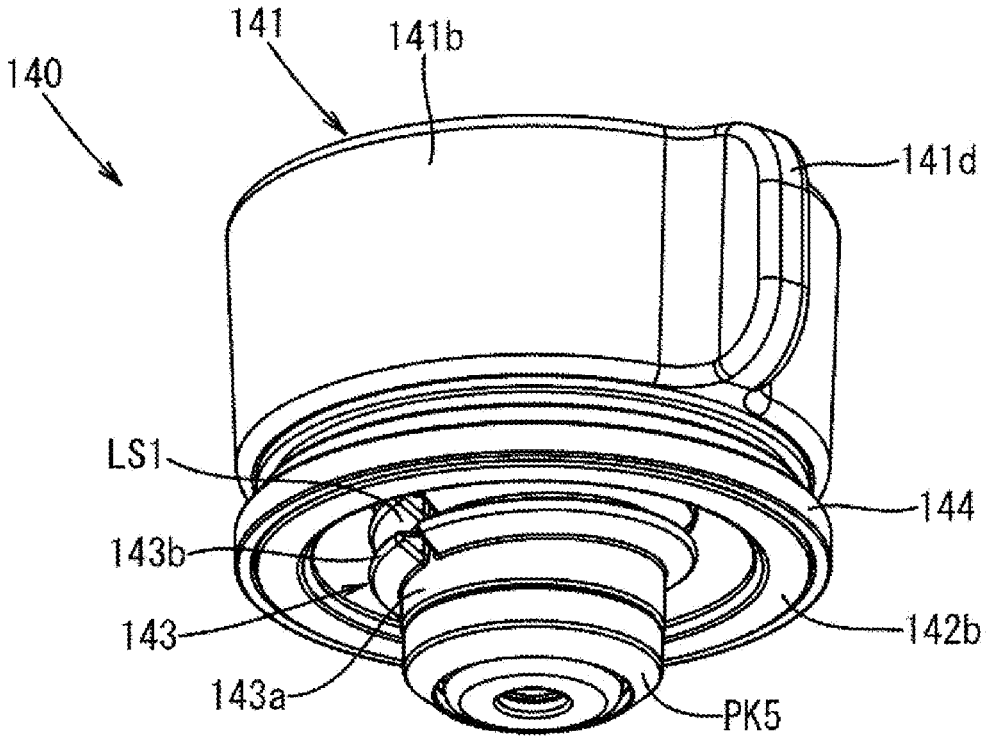
FIG. 8 is a lower-side perspective view of the plug according to the embodiment of the disclosure.

The rotating ring 144 has a substantially ring shape, and as shown in FIG. 4, FIG. 5, and FIG. 8, is attached to a lower end portion of an outer peripheral surface of the sidewall part 142*b* of the lower cover member 142 and is rotatable with respect to the sidewall part 142*b* of the lower cover member 142. In other words, when the upper cover member 141 is turned by the user in order to release the blocked state of the outlet MO of the upper sidewall part 120*a* of the cylindrical wall part 120 blocked by the plug 140 (the lower cover member 142 and the plug main body part 143 also rotate along with the upper cover member 141), the rotating ring 144 does not rotate together with the upper cover member 141, the lower cover member 142, and the plug main body part 143. Further, as shown in FIG. 4 and FIG. 5, a small ring part 301 (to be described later) of the strap 300 is attached to an outer peripheral surface of the rotating ring 144.

3. Second Packing

The second packing PK2 is a ring-shaped member formed of an elastic material such as rubber or an elastomer, and as described above, is attached to the recess formed by the step part 223 of the outer cylinder 220 and the tip wall part 224 of the outer cylinder 220. Herein, as shown in FIG. 4 to FIG. 6, when the male threaded part 120*h* of the cylindrical wall part 120 is screwed with the female threaded part 215 of the inner cylinder 210, the second packing PK2 is in contact with the inner shoulder member 112 of the shoulder member 110. In such a case, the second packing PK2 serves to close a gap between the inner shoulder member 112 of the shoulder member 110 and the outer cylinder 220.

4. Strap

The strap 300 is a member capable of connecting the shoulder member 110 and the plug 140 even after the blocked state of the outlet MO of the upper sidewall part 120*a* of the cylindrical wall part 120 blocked by the plug 140 is released (in other words, even after the plug 140 is removed from the cylindrical wall part 120), and is formed of an elastic material such as rubber or an elastomer. As shown in FIG. 1 to FIG. 5, the strap 300 is mainly formed of a small ring part 301, a large ring part 302, and a bridge part 303. As shown in FIG. 1 to FIG. 5, the small ring part 301 has a substantially ring shape and is attached to the outer peripheral surface of the rotating ring 144 of the plug 140. Accordingly, the small ring part 301 becomes rotatable together with the rotating ring 144 with respect to the sidewall part 142*b* of the lower cover member 142 of the plug 140. As shown in FIG. 1, FIG. 2, and FIG. 4 to FIG. 6, the large ring part 302 has a substantially ring shape and is fitted into the recess 112*p* of the inner shoulder member 112 of the shoulder member 110. At this time, as shown in FIG. 1, FIG. 2, FIG. 4, and FIG. 5, a boundary between the large ring part 302 and the bridge part 303 is located on a rear side of the inner shoulder member 112 of the shoulder member 110, and the large ring part 302 is non-rotatable with respect to the inner shoulder member 112 of the shoulder member 110. As shown in FIG. 1 to FIG. 5, the bridge part 303 serves to connect the small ring part 301 and the large ring part 302. Further, as shown in FIG. 1 and FIG. 4, when the outlet MO of the upper sidewall part 120*a* of the cylindrical wall part 120 is blocked by the plug 140, the bridge part 303 is deformed into a substantially arc shape, so that it also serves as a handle for carrying.

If the strap 300 is not present in the beverage container 10, when the plug body 100 is attached to the double-layer vacuum container 200 and the beverage container 10 is tilted by a certain amount or more or rolled over, depending on how it is tilted and rolled over, the pressure adjustment mechanism 130 may temporarily come completely to the lower side (in other words, a distance between the pressure adjustment mechanism 130 and a surface SF (see FIG. 7) may temporarily be the smallest). However, with the strap 300 being present in the beverage container 10, as shown in FIG. 7, it is possible to reduce the possibility that the pressure adjustment mechanism 130 comes completely to the lower side (in other words, the distance between the pressure adjustment mechanism 130 and the surface SF is the smallest).

<Use Method of Plug Body and Operation Mode Thereof>

First, a desired beverage is poured into the double-layer vacuum container 200. Next, after screwing the male threaded part 120*h* of the cylindrical wall part 120 of the plug body 100 into the female threaded part 215 of the double-layer vacuum container 200, the beverage container 10 is completed by screwing the male threaded part 143*b* of the plug 140 of the plug body 100 into the female threaded part 120*g* of the cylindrical wall part 120 of the plug body 100 (see FIG. 1 and FIG. 4). Alternatively, after screwing the male threaded part 143*b* of the plug 140 of the plug body 100 into the female threaded part 120*g* of the cylindrical wall part 120 of the plug body 100, the beverage container 10 is completed by screwing the male threaded part 120*h* of the cylindrical wall part 120 of the plug body 100 into the female threaded part 215 of the double-layer vacuum container 200. At this time, as shown in FIG. 4, the third packing PK3 is in contact with the upper end portion of the step part 213 of the inner cylinder 210 of the double-layer vacuum container 200, and the fifth packing PK5 is in contact with the inner portion of the collar part 120*c* of the cylindrical wall part 120 of the plug body 100. Accordingly, the double-layer vacuum container 200 and the plug body 100 are kept watertight. Further, as shown in FIG. 4, air is retained in the internal space SP2 of the cylindrical wall part 120. Then, when the user drinks the beverage in the beverage container 10, the screwed state between the female threaded part 120*g* of the cylindrical wall part 120 of the plug body 100 and the male threaded part 143*b* of the plug 140 of the plug body 100 is released. At this time, the gas in the beverage container 10 flows not only in the upward direction but also to the thread valley space SP4. Next, the user grasps the double-layer vacuum container 200, lifts the beverage container 10, brings the cylindrical wall part 120 of the plug body 100 to the mouth, and drinks the beverage in the beverage container 10. In such a case, the beverage in the beverage container 10 flows into the user's mouth through the internal space SP2 and the internal space SP1 of the cylindrical wall part 120. Then, when the user finishes drinking the beverage in the beverage container 10, the user screws the male threaded part 143*b* of the plug 140 of the plug body 100 into the female threaded part 120*g* of the cylindrical wall part 120 of the plug body 100.

Next, with the beverage in the beverage container 10 being effervescent drinking water (e.g., a carbonated beverage, an alcoholic beverage, etc.), the male threaded part 120*h* of the cylindrical wall part 120 of the plug body 100 being screwed with the female threaded part 215 of the double-layer vacuum container 200, and the male threaded part 143*b* of the plug 140 of the plug body 100 being screwed with the female threaded part 120*g* of the cylindrical wall part 120 of the plug body 100 (see FIG. 1 and FIG. 4), the operation mode of the pressure adjustment mechanism 130 of the plug body 100 when the internal pressure in the beverage container 10 becomes high will be described. First, when the internal pressure in the beverage container 10 is not high, as shown in FIG. 4, in the pressure adjustment mechanism 130 of the plug body 100, the urging member 132 urges the valve body 131 and the fourth packing PK4 downward, and the valve body 131 and the fourth packing PK4 block the opening OP2 of the cylindrical wall part 120 of the plug body 100. Then, when a substance (e.g., carbon dioxide or the like) dissolved in the drinking water in the beverage container 10 is vaporized to become a gas and the internal pressure in the beverage container 10 becomes high, as shown in FIG. 6, in the pressure adjustment mechanism 130 of the plug body 100, the valve body 131 and the fourth packing PK4 move upward against the urging force of the urging member 132, and the blocked state of the opening OP2 of the cylindrical wall part 120 of the plug body 100 is released. Next, as indicated by a thick arrow in FIG. 6, the gas is discharged through the opening OP2 of the cylindrical wall part 120 of the plug body 100, the internal space SP3, and the opening OP3 of the cylindrical wall part 120 of the plug body 100. Then, when the internal pressure in the beverage container 10 returns to the original state, the valve body 131 and the fourth packing PK4 are urged downward by the urging member 132 to re-block the opening OP2 of the cylindrical wall part 120 of the plug body 100. When the gas is discharged through the opening OP2 of the cylindrical wall part 120 of the plug body 100, the internal space SP3, and the opening OP3 of the cylindrical wall part 120 of the plug body 100, bubbles or the like may also pass through the opening OP2 of the cylindrical wall part 120 of the plug body 100, but bubbles or the like are trapped by the internal space SP3. Even if bubbles or the like are discharged through the opening OP2 of the cylindrical wall part 120 of the plug body 100, the internal space SP3, and the opening OP3 of the cylindrical wall part 120 of the plug body 100, bubbles or the like are collected in the beverage container 10 by the first packing PK1 and the second packing PK2.

<Characteristics of Plug Body According to the Embodiment of the Disclosure>

(1)

In the plug body 100 according to the embodiment of the disclosure, when the male threaded part 143*b* of the plug 140 is screwed with the female threaded part 120*g* of the cylindrical wall part 120, the fifth packing PK5 of the plug main body part 143 of the plug 140 is in contact with the inner portion of the collar part 120*c* of the cylindrical wall part 120 and closes the gap between the main body part 143*a* of the plug 140 and the cylindrical wall part 120. Further, the contact position between the fifth packing PK5 of the plug main body part 143 of the plug 140 and the inner portion of the collar part 120*c* of the cylindrical wall part 120 is below the inner side of the screwing position between the male threaded part 143*b* of the plug 140 and the female threaded part 120*g* of the cylindrical wall part 120. Therefore, in this plug body 100, even when a relatively high pressure is generated inside the beverage container 10 with the plug body 100 attached to the double-layer vacuum container 200 and the plug 140 attached to the cylindrical wall part 120, it is possible to maintain the sealing structure more easily than in the conventional plug body.

(2)

In the plug body 100 according to the embodiment of the disclosure, the upper sidewall part 120*a* of the cylindrical wall part 120 has a substantially cylindrical shape, and the inner portion of the collar part 120*c* of the cylindrical wall part 120 extends inward from the boundary between the upper sidewall part 120*a* and the lower sidewall part 120*b* and has a substantially ring shape. Therefore, in the plug body 100, the sealing surface formed by the fifth packing PK5 of the plug main body part 143 of the plug 140 when the plug 140 is attached to the cylindrical wall part 120 can be widened.

(3)

In the plug body 100 according to the embodiment of the disclosure, in a cross-sectional view, the angle θ1 formed by the upper surface US1 of the male threaded part 143*b* of the plug 140 with respect to the plane SF1 orthogonal to the cylinder axis line AY of the upper sidewall part 120*a* of the cylindrical wall part 120 is smaller than the angle θ2 formed by the lower surface LS1 of the male threaded part 143*b* of the plug 140 with respect to the plane SF1. Further, when the male threaded part 143*b* of the plug 140 is screwed with the female threaded part 120*g* of the cylindrical wall part 120, the upper surface US1 of the male threaded part 143*b* of the plug 140 is substantially parallel to the lower surface LS2 of the female threaded part 120*g* of the cylindrical wall part 120, and the lower surface LS1 of the male threaded part 143*b* of the plug 140 is parallel to the upper surface US2 of the female threaded part 120*g* of the cylindrical wall part 120. Therefore, in the plug body 100, the pressure resistance of the male threaded part 143*b* of the plug 140 can be improved.

(4)

In the plug body 100 according to the embodiment of the disclosure, when the male threaded part 143*b* of the plug 140 is screwed with the female threaded part 120*g* of the cylindrical wall part 120, the thread valley space SP4 is formed between the upper sidewall part 120*a* of the cylindrical wall part 120 and the plug main body part 143 of the plug 140. Therefore, in the plug body 100, when the screwed state between the female threaded part 120*g* of the cylindrical wall part 120 and the male threaded part 143*b* of the plug 140 is released and the plug is opened, the gas in the beverage container 10 that is about to go out of the beverage container 10 at once through the internal space SP1 of the cylindrical wall part 120 can flow not only in the upward direction but also to the thread valley space SP4, and the pressure in the internal space SP1 of the cylindrical wall part 120 can be dispersed. Accordingly, in the plug body 100, it is possible to suppress plug popping and noise at the time of opening the plug.

Modification Examples (A)

The shape and constituent material of each part of the plug body 100 according to the above embodiment are not particularly limited, and each part may have any shape and may be formed of any material as long as it does not deviate from the gist of the disclosure. For example, in the plug body 100 according to the above embodiment, the shoulder member 110 and the cylindrical wall part 120 are formed of a resin or the like, but they may also be formed of metal or the like.

(B)

In the plug body 100 according to the above embodiment, the internal space SP2 is formed by the lower sidewall part 120*b*, the lower containment wall part 120*e*, the front containment wall part 120*f*, and the third packing attachment wall part 120*i* of the cylindrical wall part 120; the internal space SP3 is formed by the lower sidewall part 120*b*, the upper containment wall part 120*d*, the lower containment wall part 120*e*, and the front containment wall part 120*f* of the cylindrical wall part 120; and the shoulder member 110, the strap 300, the first packing PK1, the second packing PK2, and the like are provided. However, some or all of the parts and members thereof may be omitted within a range that does not deviate from the gist of the disclosure.

(C)

In the plug body 100 according to the above embodiment, a male threaded type plug having the male threaded part 143*b* formed on the plug main body part 143 is adopted as the plug 140, but the plug 140 is not limited to the male threaded type, and other types of plug such as a female threaded type plug may also be adopted. When a female threaded type plug is adopted, it is preferable that a male threaded part is formed on the outer peripheral surface of the upper sidewall part 120*a* of the cylindrical wall part 120.

(D)

In the beverage container 10 according to the above embodiment, a beverage (including an effervescent beverage) is poured into the double-layer vacuum container 200, but the content to be contained in the double-layer vacuum container 200 is not particularly limited.

(E)

In the above embodiment, the double-layer vacuum container 200 is adopted as the container, but the container is not particularly limited, and may also be, for example, a general single-walled container. Further, in the above embodiment, stainless steel is adopted as the material of the container, but the material of the container may also be an alloy other than stainless steel, a resin, or the like.

(F)

In the plug body 100 according to the above embodiment, in a cross-sectional view cut along a plane including the cylinder axis line AY of the upper sidewall part 120*a*, the male threaded part 143*b* of the plug 140 in which the angle θ1 is smaller than the angle θ2 is adopted, and the female threaded part 120*g* of the cylindrical wall part 120 in which the lower surface LS2 is substantially parallel to the upper surface US1 of the male threaded part 143*b* of the plug 140 and the upper surface US2 is parallel to the lower surface LS1 of the male threaded part 143*b* of the plug 140 is adopted. However, in the above cross-sectional view, a male threaded part 143*b* of the plug 140 in which the angle θ1 is equal to the angle θ2 may also be adopted, and a female threaded part 120*g* of the cylindrical wall part 120 in which the lower surface LS2 is substantially parallel to the upper surface US1 of the male threaded part 143*b* of the plug 140 and the upper surface US2 is parallel to the lower surface LS1 of the male threaded part 143*b* of the plug 140 may also be adopted. Further, in the above cross-sectional view, a male threaded part 143*b* of the plug 140 in which the angle θ1 is larger than the angle θ2 may also be adopted, and a female threaded part 120*g* of the cylindrical wall part 120 in which the lower surface LS2 is substantially parallel to the upper surface US1 of the male threaded part 143*b* of the plug 140 and the upper surface US2 is parallel to the lower surface LS1 of the male threaded part 143*b* of the plug 140 may also be adopted.

(G)

In the plug body 100 according to the above embodiment, in a cross-sectional view cut along a plane including the cylinder axis line AY of the upper sidewall part 120*a*, the lower surface LS2 of the female threaded part 120*g* is substantially parallel to the upper surface US1 of the male threaded part 143*b* of the plug 140, but the lower surface LS2 of the female threaded part 120*g* may also be designed to be completely parallel to the upper surface US1 of the male threaded part 143*b* of the plug 140.

(H)

In the plug body 100 according to the above embodiment, the male threaded part 143*b* of the plug 140 is not cut to the position at which the fifth packing PK5 of the plug main body part 143 of the plug 140 and the inner portion of the collar part 120*c* of the cylindrical wall part 120 are in contact with each other when screwed with the female threaded part 120*g* of the cylindrical wall part 120, but it may also be cut to the position at which the fifth packing PK5 of the plug main body part 143 of the plug 140 and the inner portion of the collar part 120*c* of the cylindrical wall part 120 are in contact with each other.

The above modification examples may be applied alone or in combination.

What is claimed is:

1. A plug body comprising:

a spout part, having a hollow cylindrical shape;

a collar part, disposed on a lower side of the spout part, the collar part having a ring shape extending from an inner wall surface of the spout part toward a cylinder axis of the spout part, the collar part having a hole;

a plug comprising a fitting part and removably fitted to an inner side of the spout part; and a sealing member in a ring shape attached to a lower side of the fitting part of the plug, wherein when the plug is inserted to the spout part, the sealing member of the fitting part is in contact with the collar part of the spout part at a sealing position to form a sealing structure, wherein the fitting part is a male threaded part formed on an outer circumference of the plug, the spout part comprises a cylindrical body and a female threaded part formed on an inner side of the cylindrical body and configured to be screwed with the male threaded part, in a cross-sectional view cut along a plane including a cylinder axis of the cylindrical body, an angle formed by an upper surface of the male threaded part with respect to a plane orthogonal to the cylinder axis is smaller than an angle formed by a lower surface of the male threaded part with respect to the plane orthogonal to the cylinder axis, and an upper surface and a lower surface of the female threaded part are substantially parallel to the lower surface and the upper surface of the male threaded part.

2. The plug body according to claim 1, wherein the male threaded part is not threaded to the sealing position, and the female threaded part is threaded to the sealing position.

3. A beverage container comprising:

the plug body according to claim 1; and a container in a bottomed cylindrical shape to which the plug body is attached.

* * * * *